United States Patent [19]

Fisher

[11] Patent Number: 4,789,057

[45] Date of Patent: Dec. 6, 1988

[54] TAMPER RESISTANT CONTAINERS

[76] Inventor: William Fisher, Rte. 1, Box 69, Boyceville, Wis. 54725

[21] Appl. No.: 170,309

[22] Filed: Mar. 18, 1988

[51] Int. Cl.[4] ..... A45C 13/10

[52] U.S. Cl. ..... 206/1.5; 215/209

[58] Field of Search ..... 215/209, 221, 224, 225, 215/12; 206/1.5, 530, 807; 220/8

[56] References Cited

U.S. PATENT DOCUMENTS

| | | | |
|---|---|---|---|
| 3,101,856 | 8/1963 | Whiteman, Jr. | 215/209 |
| 3,360,147 | 12/1967 | Schaeffer | 215/209 |
| 3,399,764 | 9/1968 | Rigor | 206/1.5 |
| 3,828,961 | 8/1974 | Lewis | 215/223 |
| 3,844,407 | 10/1974 | Buie | 206/1.5 |
| 3,868,036 | 2/1975 | Whittauer | 215/12 |
| 3,907,103 | 9/1975 | Shaw | 206/1.5 |
| 3,912,073 | 10/1975 | Lewis | 206/1.5 |
| 3,968,871 | 7/1976 | Briscoe | 206/1.5 |

*Primary Examiner*—George T. Hall

*Attorney, Agent, or Firm*—Jacobson and Johnson

[57] ABSTRACT

A tamper resistant container that can be readily opened by an elderly person but is difficult for a young child to open comprising a first container for holding toxic substances having a threaded section for engaging a cover and a friction region, a cover having a threaded section for engaging the first container to close and seal toxic substances in the first container, a second container located outside the first container, and including means to permit free rotation of the first container when the cover on the first container is rotated in a direction to unscrew the cover to thereby thwart a young child from opening the tamper resistant container. The second container includes means to prevent rotation of the first container with respect to the second container when the cover is rotated in a direction to unscrew the cover by the user squeezing on specific regions on the outside of the second container so as to prevent rotation of the first container to thereby permit the user to unscrew the cover from the first container.

26 Claims, 3 Drawing Sheets

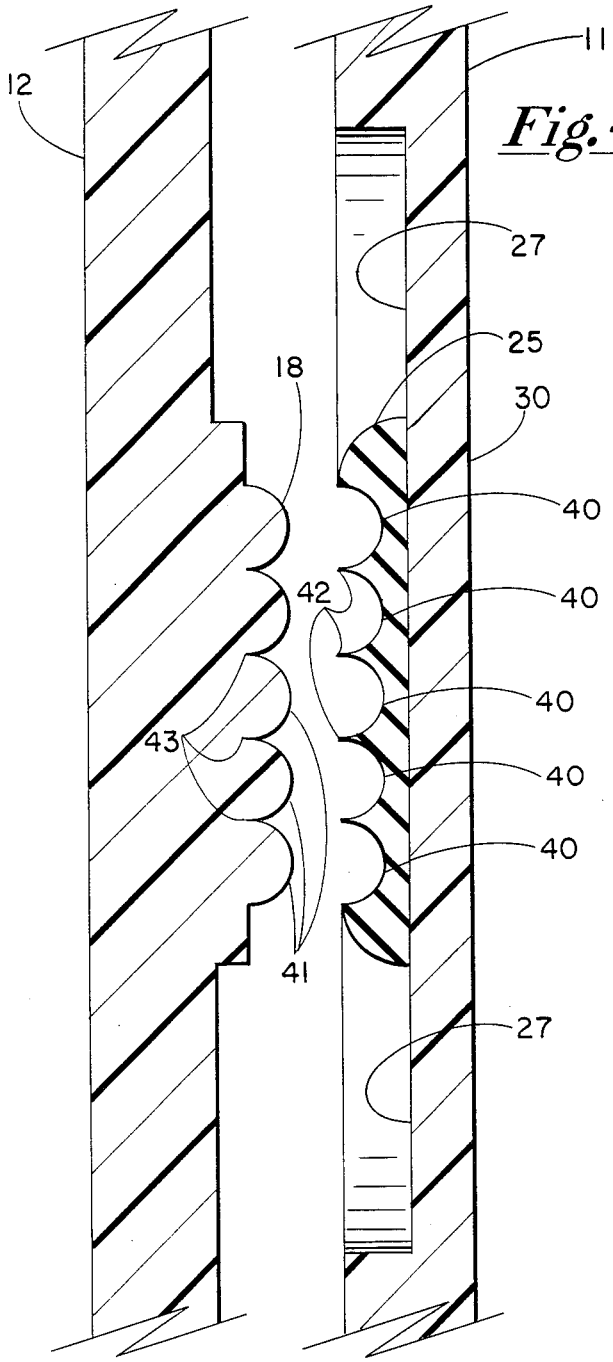
Fig.-9
Fig.-10
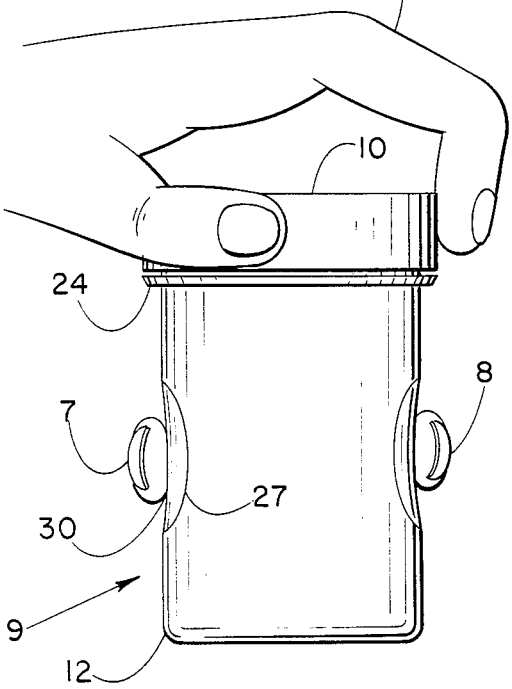

TAMPER RESISTANT CONTAINERS

FIELD OF THE INVENTION

This invention relates generally to tamper resistant containers and, more specifically, to a container that can be readily opened by the elderly yet can not be opened by young children.

BACKGROUND OF THE INVENTION

The concept of tamper resistant or safety containers is old in the art. The need for safety containers arose because each year many children die from accidentally ingesting prescription or nonprescription medicine. To avoid unnecessary death of children, container manufacturers have made containers that are difficult for children to open. Unfortunately, the containers have also been difficult for the elderly to open. Consequently, the elderly have been forced to leave the medicine container uncapped or to place the medicine in other containers that were not child-proof. As a result the safety containers, although effective in preventing children from opening the containers, become ineffective since the elderly oftentimes cannot use them. Thus a need exists for a safety container that is usable by the elderly yet prevents children from opening the container. Because the muscles in the elderly deteriorate from nonuse and age, it is difficult to make a tamper resistant container that the elderly can readily open. The present invention utilizes the muscles in the elderly that are used on a daily basis for such activities as eating, writing, and picking up items. One such set of muscles that are used on a daily basis are the muscles of the finger and thumb that are used to grasp objects.

The present invention provides a tamper resistant or safety container that permits the elderly person with diminished physical coordination, strength, and skill to open the container yet still prevents young children from opening the container. The present invention also permits an elderly person to use the well established conventional motor skills used in opening a screw top container yet because of the requirement that container needs to be grasped and held in a particular manner and at specific regions on the container virtually precludes young children from being able to open the container.

In the present invention four motions occur at the same time. With one hand the user grips the outer container and applies pressure at specific regions on the container and with the other hand the user grips and turns the cap. The functions required to open the container are divided between both hands which is better for an elderly person who may lack sufficient hand strength to perform more involved steps that require exertion of unusual force with one hand and very little force with the other. The present invention permits the elderly to use a more comfortable hold and squeeze motion rather than a squeeze and turn motion found in prior art safety containers. In addition very little torque is required to open the container since the cover mates with the container in a conventional manner. Also, because of the natural way the hand is placed on the container the squeezing motion is easier to apply to the container than it is with prior at devices that require the cap to be squeezed and turned at the same time.

DESCRIPTION OF THE PRIOR ART

The Rigor U.S. Pat. No. 3,399,764 shows a medicine bottle with an inner and outer container with a magnet located on the bottom of the inside container and on the bottom of the outside container. When the poles in the magnets are in opposite position the magnets hold the inner container inside the outer container. By rotating the inner container a half turn the magnets are placed in a repelling mode which forces the inside container partially outside of the outside container thereby permitting the user to grasp and remove the closure on the inner container. Generally, such type of containers are difficult for the elderly to open since not only is it an unconventional opening technique but it also requires one to align markings that may be hard for the elderly to see.

The Shaw U.S. Pat. No. 3,907,103 shows a rectangular safety container having a hinged lid and latches which are released by squeezing on the walls of the container to release the latches. Each of the opposite sidewalls must be squeezed to open the lid on the container. This type of container suffers from the disadvantage that it requires the elderly to learn a new procedure before the container can be opened and in addition it is sometimes difficult for the elderly person to see that the first squeezing motion was sufficient to partially open the lid.

The Whiteman U.S. Pat. No. 3,101,856 shows a bottle closure having ratchet teeth that engage the container to prevent unscrewing the closure unless the user also squeezes on the container to disengage the ratchet teeth on the closure from the container. Such containers require the user to apply and hold pressure on the side of the container to disengage the teeth on the cap from the teeth on the container. Whiteman points out that the use of stiff material requires strength not found in young children. Unfortunately, elderly people also often lack the strength to open such a container. In addition the container requires the user to place their fingers in an unnatural position for opening a container.

The Wittwer U.S. Pat. No. 3,868,036 shows a closure that must be squeezed along the rib area to bring the outer cover into engagement with the inner cap to permit rotation of the inner cover. This container suffers from the disadvantage that it requires the user to squeeze harder than normal to open the container.

The Schaefer U.S. Pat. No. 3,360,147 shows a safety container that uses a ratchet tooth cap and a bottle that is squeezed to disengage the ratchet teeth from the container. The Schaefer patent is similar to the Whiteman in that both require the user to apply high hand pressure to squeeze the container to disengage the cap from teeth located on the container.

The Lewis U.S. Pat. No. 3,912,073 shows a safety container having an inner container and an outer sleeve with wells that must be in engagement with tabs before the container can be opened.

The Lewis U.S. Pat. No. 3,828,961 shows a similar container that has a circumferential rib to hold the cover on the container.

SUMMARY OF THE INVENTION

Briefly, the invention comprises a tamper resistant container having an inner container that is capped and is freely rotatable within an outer container unless specific regions on the outside container are squeezed to engage a hidden brake to hold the inside container from rotating. The pressure points on the outside container have been found to permit the elderly to squeeze the container and remove the cap even though their physical strength may be diminished since the motor skills required to open the container are the same motor skills that the elderly have previously used to open other containers with screw-on covers. In addition, children have difficulty in performing the squeezing and holding action since it requires a use of small motor movement skills that are not fully developed in children. Because the brake is hidden and in one embodiment requires squeezing on two locations of the container, a young child observing someone opening the container cannot readily determine how the user opened the container. Oftentimes the young child believes that the container is "magical" and doesn't attempt to figure out how to open the container. The invention also includes a set of teeth on the containers that permit free rotation in one direction but prevent free rotation of the containers with respect to one another when the user is tightening the cover on the container.

BRIEF DESCRIPTION OF THE DRAWINGS

FIG. 9 shows an enlarged view of the friction pad and the brake on the inside container; and FIG. 10 shows a user's hands opening the tamper resistant container.

DESCRIPTION OF THE PREFERRED EMBODIMENT

Figure 1:
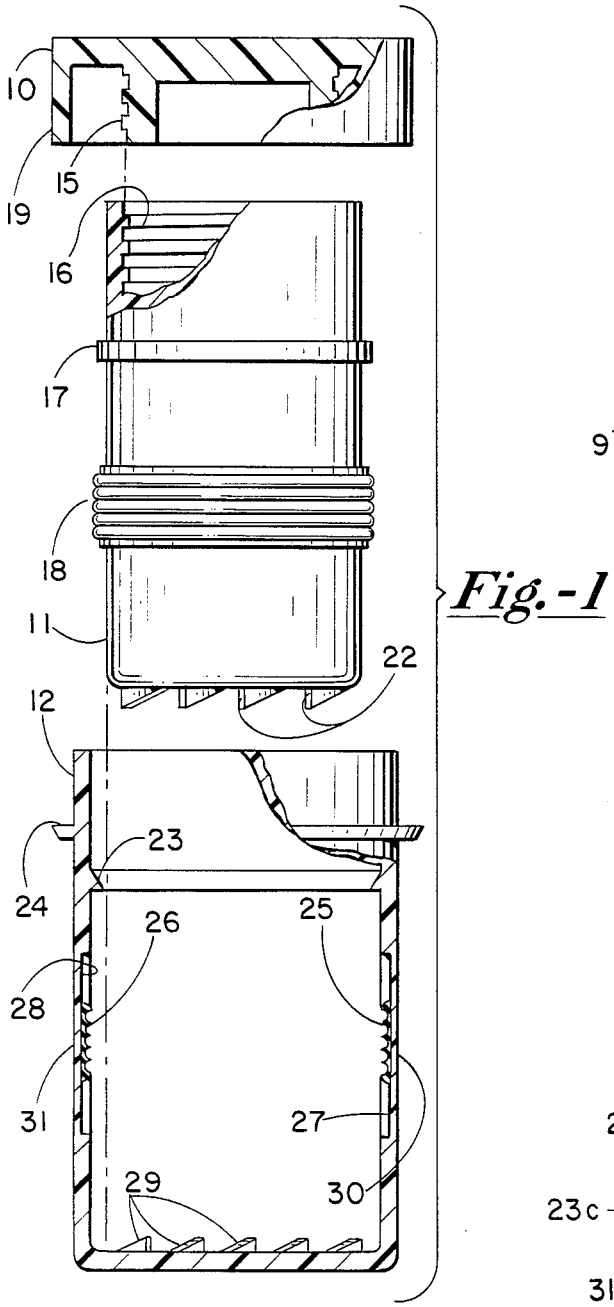
FIG. 1 is an exploded view of my safety container.

Referring to FIG. 1, reference numeral 10 generally identifies the screw-on cover that has an annular lip 19 that freely rotates about the outside of container 12. Reference numeral 11 identifies the inner medicine container and reference numeral 12 identifies the outer container which the user grasps and squeezes in specific locations during the opening process. Cover 10 has threads 15 which frictionally engage mating threads 16 located on inner container 11 to frictionally hold cover 10 on container 11. Located on the side of inner container 11 is a circumferential ring 17 that fits under a circumferential tapered lip stop 23 that prevents inner container 11 from being removed from outer container 12 once inner container 11 is slid into container 12. That is, lip 23 and containers 11 and 12 have sufficient flexibility that inner container 11 can be inserted in outer container 12 by forcing ring 17 downward over tapered lip 23. The diameter of inner container 11 is of sufficent size so that there is a slight clearance between the outside diameter of inner container 11 and the inside diameter of outer container 12 to permit free rotation of container 11 within container 12 when a user grasps and turns cover 10 on container 11. When used as a container for medication the container 9 is made of a polymer plastic such as styrene or the like, however, other suitable materials are usable with my invention.

In order to prevent inner container 11 from rotating when cover 10 is rotated, I provide means on container 11 and container 12 to frictionally engage one another so the user can prevent rotation of inner container 11 by grasping and applying pressure in selected regions on outer container 12. Container 11 includes a cylindrical band 18 comprised of a plurality of spaced, parallel, convex ridges which in the preferred embodiment are made on the outside surface of the inner container 11. In an alternate embodiment the cylindrical band could be made of a frictional material such as rubber or the like and fitted directly to the outside of inner container 11. Container 12 has a pair of circular friction pads 25 and 26 which are located diametrically opposite of each other on the inside of outer container 12. Located around friction pad 25 is an annular resilient flexing region 27 that permits friction pad 25 to move inward when pressure is applied to circular region 30 located and marked on the outside of outer container 12. Similarly, located on the opposite side of container 12 is an annular resilient flexing region 28 that permits friction pad 26 to move inward when pressure is applied to circular region 31 located and marked on the outside of outer container 12. The marking on the outside could be a colored dot or the like that directs the user's fingers to the area which must be squeezed to open the container. The simultaneous inward pressure on regions 30 and 31 forces friction pads 25 and 26 radially inward to engage friction band 18. The engagement of friction pads 25 and 26 with friction band 18 prevents rotation of inner container 11 with respect to container 12 to permit a user to unscrew cover 10 by turning cover 10 when holding and squeezing on specfic regions 30 and 31 on the outside of outer container 12.

It should be noted that the present invention provides for resilient flexing regions 27 and 28 which are regions that have less strength than the rest of the container which in effect creates a container having a "weak spot" that makes it relatively easy for an elderly person to open the container since very little squeezing force is required to squeeze container 12. Although very little force is required to force friction pads 25 and 26 into engagement with friction band 18, it is difficult for a young child to perform the squeezing and holding function since the young child must know that squeezing and holding is required in specific regions on the outside of container 12. In adddition, since the large motor skills of young children (such as hand grasping actions) predominate over small motor skills such as applying finger pressure, it is very difficult for a young child to provide both the squeezing and holding action necessary to open container 11. The normal motor action for the child is to grasp container 12 with the entire hand and not to apply pressure on specific regions of the container. Consequently, container 11 freely rotates within container 12 thus preventing the child from removing the cover from container 11.

FIG. 9 shows an enlarged view of friction pad 25 and cylindrical brake 18 which is molded directly in the side of container 12. Band 18 comprises a set of annular convex ridges 41 that are located next to each other in a parallel arrangement separated by annular grooves 43. Friction pad 25 has a mating surface with concave sections 40 that engage the convex portions 41 when pad 25 is squeezed against band 12. Friction pad 25 also has ridges 42 that engage the grooves 43 in band 18. The use of mating surfaces that have a contoured shape are preferred to surfaces that are not contoured since the use of contoured surfaces produces greater surface area contact for a given length of friction pad. In addition, the use of ridges 22 forms an interfering engagement with grooves 43 to provide an almost pinching effect to enhance the braking resistance. The friction pad 26 is identical to friction pad 25 and will not be described.

Figure 2:
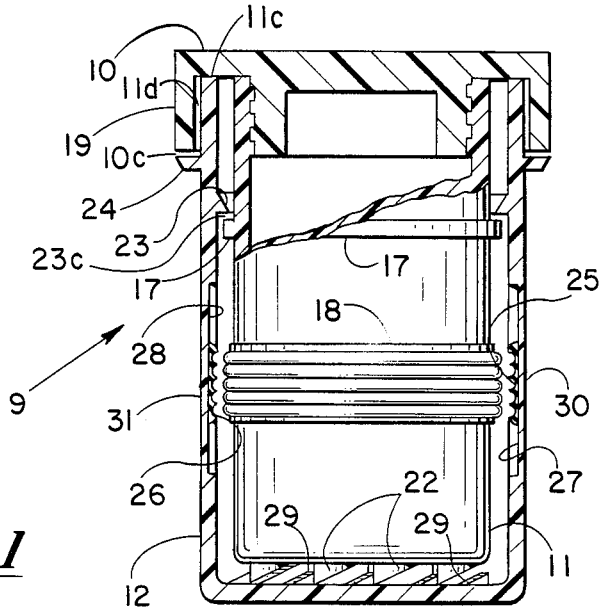
FIG. 2 is a side sectional view of my safety container in an assembled condition.

Referring to FIG. 2 container 9 is shown in the assembled condition with inner container 11 located inside outer container 12. In the assembled condition inner container 11 is free to rotate with cover 10 if the user merly grasps outer container 12 and attempts to unscrew cover 10. The circular lip 23 is spaced a distance 23*c* from circular ridge 17 which prevents withdrawal of inner container 11 from outer container 12. The spacing of lip 23 from ridge 17 permits inner container 11 to axially tip or laterally slide within the confines of outside container 12. If inner container 11 is permitted to tip axially, it is necessary to have pressure on both squeeze regions 30 and 31 in order to prevent rotation of inner container 11. If inner container 11 were not permitted to tip slightly axially, it may be possible for pressure on only one specific region to prevent rotation of the inner container. However, with inner container 11 being able to tip axially insures that the outside of the container 12 must be squeezed in two specific regions to prevent free rotation of inner container. In addition, cover 10 is spaced a distance 11*d* from container to permit the axially tipping or displacement of inner container should pressure be applied to only one specific region on the outside of container 12.

FIG. 2 also shows that cover 10 engages area 11*c* on container to prevent a child from pushing down on cover 10 in an attempt to stop the rotation of inner container 11.

To permit closing of container 9 without any special holding action on the user, I provide an annular set of ratchet teeth 22 on the bottom of inner container 11 that engages a similar annular set of smaller mating ratchet teeth 29 to prevent rotation of container 11 with respect to container 12 when cover 10 is tightened but slip past each other when the cover 10 is turned in the direction to loosen the cover. Ratchet teeth 22 and ratchet teeth 29 thus coact with each other to prevent rotation of container 11 with respect to container 12 when cover 10 is tightened but not when cover 10 is loosened. If desired, the same holding and squeezing action could be employed for the closing of cover 10, however, the use of ratchet teeth that only function when the cover 10 is opened makes it somewhat easier for an elderly person to use the container.

Figure 5:
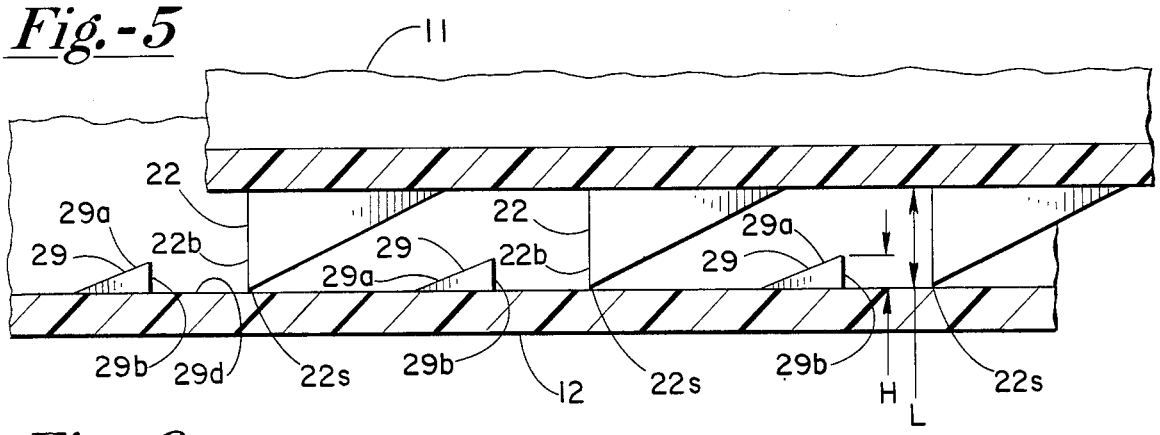
FIG. 5 is an enlarged view of the teeth on the containers that permit rotation in one direction and prevent rotation in the opposite direction.

The detail and the operation of ratchet teeth 22 and 29 is illustrated in FIGS. 5 through 8. FIG. 5 shows ratchet teeth 22 located in the flat region 29*d* between adjacent teeth 29. Ratchet teeth 29 have a height designated by L and ratchet teeth 29 have a height designated by h. Ratchet teeth 29 have a ramped or angled top surface 29*a* and a rear surface 29*b*. Similarly, ratchet teeth 22 have a ramped or angled surface and a backside surface 22*b*. The tip of ratchet teeth 22 is designated by reference numeral 22*s* and constitutes the region of teeth 22 that engage the surface 29*a* on teeth 29 as the inside container is rotated with respect to the outside container 12.

Figure 6:
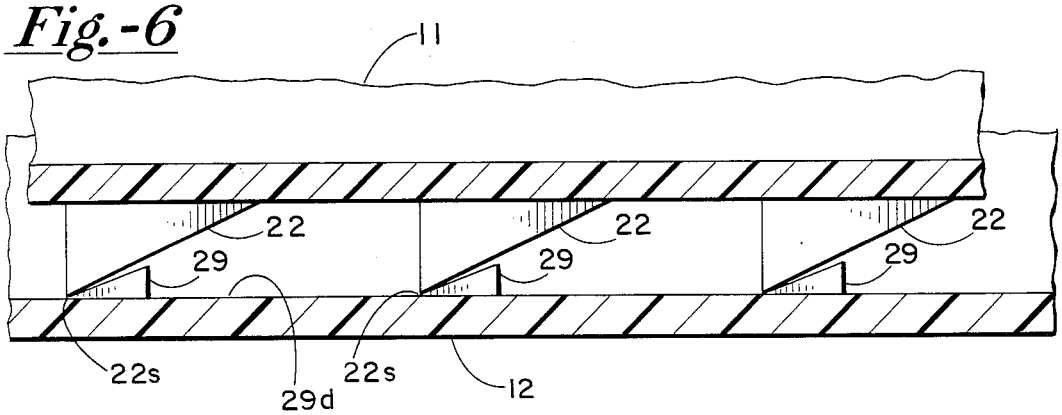
FIG. 6 shows the container teeth as they are about to slide over each other.

FIG. 6 illustrates the position of teeth 29 and 22 as the ramped portion of the teeth begin to engage each other. It should be noted that the angle on teeth 29 is different from the angle on teeth 22 so that only a small portion 22*s* will engage teeth 29. The reason the surface area contact between teeth 29 and 22 is kept to a minimun is to reduce the frictional drag between inner container 11 and outer container 12. That is, when one grasps cover 10 and container 12 one wants to be assured that the frictional drag between the two containers is insufficient to prevent free rotation between the two containers.

Figure 7:
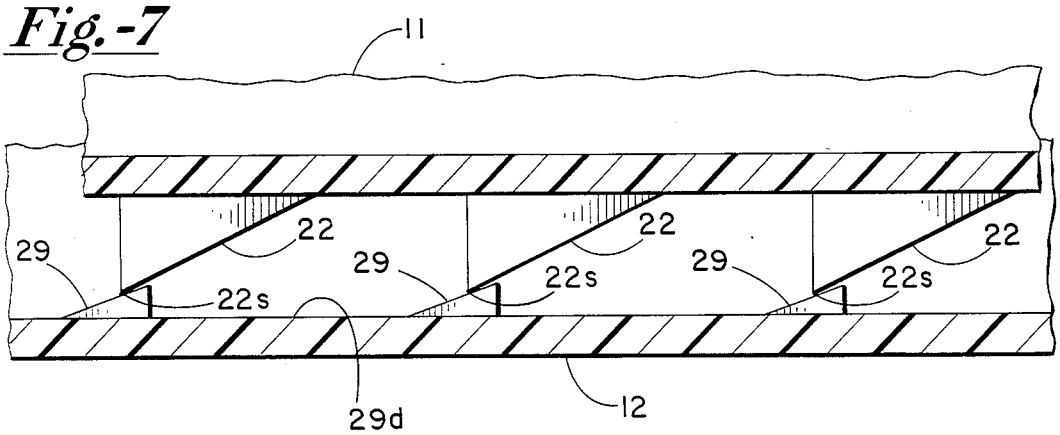
FIG. 7 shows the container teeth as they are sliding past each other.

FIG. 7 illustrates the position of ratchet teeth 29 and 22 as teeth 22 pass over teeth 29. Note, container 11 is displaced upward slightly to permit teeth 22 to ride over teeth 29.

Figure 8:
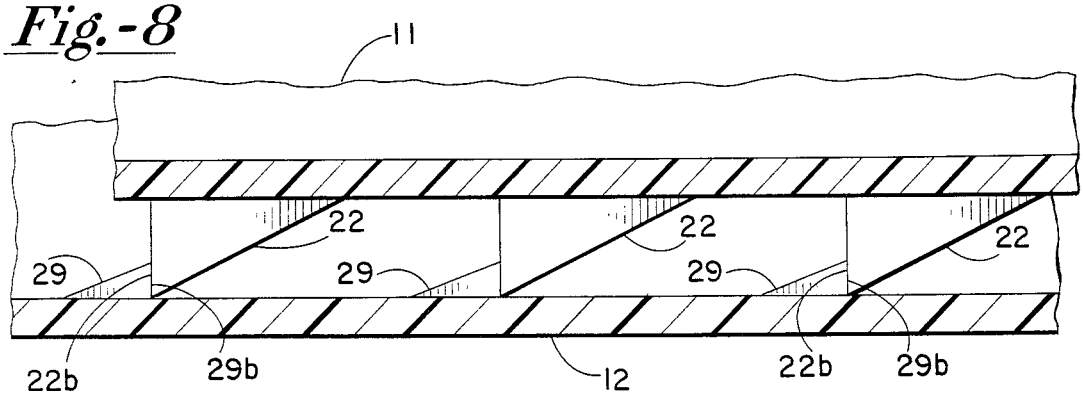
FIG. 8 shows the container teeth in the locked position to permit closing of the container.

FIG. 8 shows teeth 29 and 22 with surfaces 29*b* and 22*b* in engagement with each other. In this position container 11 and container 12 cannot rotate past each other in one direction but they can rotate past each other in the opposite direction. Consequently, the one-way action of teeth 22 and 29 is such that container 11 can be held with container 12 without having to squeeze outer container 12. This enables the user to tightly close cover 10 on container 11. However, since the teeth slide past each other in the opposite direction of rotation, one must grasp and hold container 12 in the specific regions 30 and 31 to prevent rotation of inner container 11.

Figure 3:
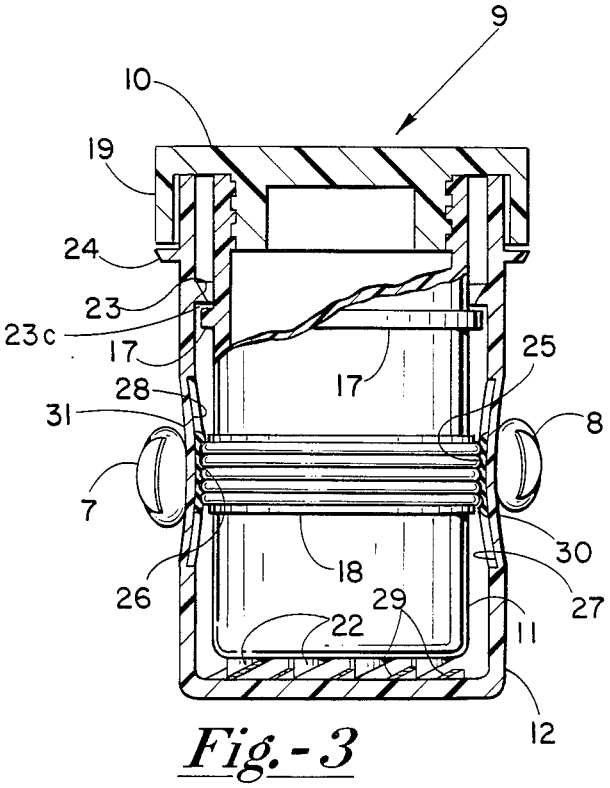
FIG. 3 shows a side sectional view of my safety container with the sides of the outer container engaging the friction ring on the inner container.

FIG. 3 shows container 9 with a user's thumb 8 and a finger 7 grasping and holding friction pads 25 and 26 in contact with friction band 18. The user's thumb 8 is located on pressure region 30 and the user finger 7 is located on pressure region 31 in a grasping manner that a user is accustomed to in opening similar containers without tamper resistant features.

Figure 4:
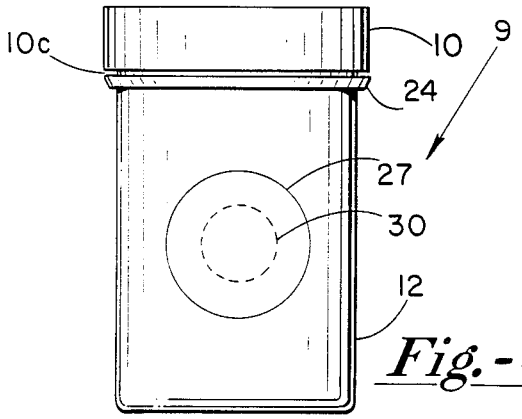
FIG. 4 shows an exterior front view of my safety container.

FIG. 4 shows a side view of container 9 revealing the marked pressure region 30 where the user squeezes to force friction pad 25 against friction band 18. A similar region 31 is marked on the diametrically opposite side of outer container 12 so that the squeezing action between the finger and thumb simultaneously forces both friction pads 25 and 26 to engage friction band 18. In the preferred embodiment pressure regions 30 and 31 are flush with the exterior of container 12 so as not to direct the child's attention to a raised area that might require squeezing.

Also, in the preferred embodiment friction pads 25 or 26 have sufficiently small area so that the normal squeezing pressures applied to only one region is insufficient to restrain container 11 from rotating within container 12 as one attempts to unscrew cover 10. If the pressure is applied simultaneously to both regions 30 and 31, the combination of squeezing from both sides ensures that the inner container 11 can be restrained from rotation to permit one to unscrew cover on inner container 11. FIG. 4 also shows a lip 24 on the outside of container 12 that mates with the lower edge of lip 19 of cover 10 to prevent a youngster from inserting a tool underneath the cover to pry off cover 10.

FIG. 10 illustrates how my tamper resistant container 9 is held and grasped with thumb 8 and finger 7 as a user uses the left hand 6 to remove cover 10.

While inner container 11 is shown with a closed bottom to contain toxic substances, one could remove the bottom from container 11 and use the bottom of container 12 as the bottom of the container 9 and the cylindrical sides of container 11 as the cylindrical sides of container 9.

I claim:

1. A tamper resistant container that can be readily opened by an elderly person but is difficult for a young child to open comprising:

a first container for holding toxic substances, said first container having an inside and an outside, said first container having a threaded section for engaging a cover and a friction region;

a cover having a threaded section for engaging said first container to close and seal toxic substances in said first container;

a second container having an inside and an outside, said second container located outside said first container, said second container including means to permit free rotation of said first container when said cover on said first container is rotated in a direction to unscrew said cover to thereby thwart a young child from opening said tamper resistant container, said second container including means to prevent rotation of said first container with respect to said second container when said cover is rotated in a direction to unscrew said cover, said means activable to engage said friction region on said first container by the user squeezing on a specific region on the outside of said second container so that said friction region on said first container engages said means to prevent rotation of said first container to thereby permit the user to unscrew said cover from said first container.

2. The tamper resistant container of claim 1 wherein said friction region comprises a cylindrical band located on the outside of said first container.

3. The tamper resistant container of claim 2 wherein said means to prevent rotation comprises a pair of friction pads located on the inside of said second container.

4. The tamper resistant container of claim 3 wherein said second container includes a resilient flexing region located around each of said friction pads to permit a user to flex said friction pads inward by squeezing on said specific regions on the outside of said container.

5. The tamper resistant container of claim 4 wherein said friction pads are located diametrically opposite to each other on the inside of said second container.

6. The tamper resistant container of claim 5 wherein said first container includes ratchet teeth and said second container includes mating ratchet teeth to prevent rotation of said first container with respect to said second container when said cover is rotated in a direction to tighten said cover on said first container.

7. The tamper resistant container of claim 6 wherein said resilient flexing regions have an annular shape and provide a weak spot on said second container to facilitate an elderly person to engage said friction pads and said friction region.

8. The tamper resistant container of claim 7 wherein said cover has an outer lip that extends partially over the outside of said second container.

9. The tamper resistant container of claim 8 wherein said tamper resistant container is made of a polymer plastic.

10. The tamper resistant container of claim 9 wherein said first container has a ridge to engage a ridge on said second container to prevent said first container from being withdrawn from said second container.

11. The tamper resistant container of claim 10 wherein said flexing region on said second container has a middle region and said flexing regions are located in the middle region of said second container.

12. A tamper resistant container that is difficult for a youngster to open but can readily be opened by an elderly person even though the youngster may have greater physical strength than the elderly person comprising:

a first container, said first container having a screw on cover;

a second container, said first container rotatable mounted in said second container to prevent a youngster from removing said cover through rotation of said cover while grasping said second container, means for prevention of rotation of said first container with respect to said second container when said second container is held and squeezed between the user's finger and thumb of one hand so that when the user rotates the cover with the other hand the cover can be removed from the first container.

13. The tamper resistant container of claim 12 wherein said means includes a friction band located on said first container and friction pads located on said second container.

14. The tamper resistant container of claim 12 wherein said second container includes resilient flexible regions to permit said second container to be flexed into engagement with said first container to prevent rotation of said first container with respect to said second container.

15. The tamper resistant container of claim 12 wherein said second container mates with said cover to completly conceal said first container.

16. The tamper resistant container of claim 12 wherein said first container includes means to automatically prevent rotation of said first container in said second container when said cover is tightened on said first container.

17. The tamper resistant container of claim 12 wherein said second container has marked regions to alert a user to the regions on said second container that must be squeezed to prevent rotation of said first container in said second container when said cover is removed from said second container.

18. The tamper resistant container of claim 12 wherein said first container has ratchet teeth and said second container has ratchet teeth that engage each other to prevent rotation of said first container with respect to said second container when said cover is tightened on said tamper resistant container.

19. The tamper resistant container of claim 12 wherein said means for prevention of rotation includes a pair of friction pads having a contoured surface for mating with a friction band having a mating contoured surface.

20. The tamper resistant container of claim 19 wherein said friction band is located on said first container.

21. The tamper resistant container of claim 20 wherein said first container is loosely mounted in said second container to permit axially tipping of said first container if only one of said friction pads is forced into contact with said band to thereby permit said first container to rotate with respect said second container unless both of said friction pads are brought into frictional contact with said band.

22. The tamper resistant container of claim 20 wherein said first container has no bottom.

23. The tamper resistant container of claim 14 wherein said flexible regions are identified on the outside of said second container by colored markings.

24. The tamper resistant container of claim 14 wherein flexible regions are flush with the outside surface of said second container.

25. The invention of claim 18 wherein said ratchet teeth have ramped surfaces of different angles to minimize the surface-to-surface contact of said ratchet teeth as said ratchet teeth pass over each other as the first container is rotated with respect to said second container.

26. The tamper resistant container of claim 18 wherein said ratchet teeth on said first container are substantially larger than the teeth on said second container to permit said first container to rotate past said second container.

* * * * *